US011430597B2

(12) United States Patent
Huang et al.

(10) Patent No.: US 11,430,597 B2
(45) Date of Patent: Aug. 30, 2022

(54) INDUCTOR MAGNETIC CORE AND INDUCTOR USING THE SAME

(71) Applicant: MAGSONDER INNOVATION (SHANGHAI) CO., LTD., Shanghai (CN)

(72) Inventors: Zhi Huang, Shanghai (CN); Jiang Chu, Shanghai (CN); Yuetao Duan, Shanghai (CN); Guilin Jiang, Shanghai (CN)

(73) Assignee: MAGSONDER INNOVATION (SHANGHAI) CO., LTD., Shanghai (CN)

( * ) Notice: Subject to any disclaimer, the term of this patent is extended or adjusted under 35 U.S.C. 154(b) by 453 days.

(21) Appl. No.: 16/622,686

(22) PCT Filed: Jul. 14, 2017

(86) PCT No.: PCT/CN2017/092980
§ 371 (c)(1),
(2) Date: Dec. 13, 2019

(87) PCT Pub. No.: WO2019/010698
PCT Pub. Date: Jan. 17, 2019

(65) Prior Publication Data

US 2020/0335252 A1 Oct. 22, 2020

(51) Int. Cl.
*H01F 27/24* (2006.01)
*H01F 27/28* (2006.01)

(52) U.S. Cl.
CPC ..... *H01F 27/24* (2013.01); *H01F 27/28* (2013.01)

(58) Field of Classification Search
CPC . H01F 27/24; H01F 27/28; H01F 3/14; H01F 27/38; H01F 37/00; H01F 2003/106; H01F 3/10
See application file for complete search history.

(56) References Cited

U.S. PATENT DOCUMENTS

2007/0152513 A1* 7/2007 Shikayama ..... H02K 41/03 310/12.25
2012/0119869 A1* 5/2012 Yamamoto ..... H01F 27/255 336/212

(Continued)

FOREIGN PATENT DOCUMENTS

CN 101661832 A 3/2010
CN 102360844 A 2/2012

(Continued)

*Primary Examiner* — Pinping Sun
(74) *Attorney, Agent, or Firm* — Muncy, Geissler, Olds & Lowe, P.C.

(57) ABSTRACT

An inductor magnetic core and an inductor using the same are disclosed. The inductor magnetic core includes a middle column, an upper yoke, a lower yoke, and at least two high magnetically-permeable side columns. The middle column is disposed between a middle part of the upper yoke and a middle part of the lower yoke, a coil is wound the middle column, and a saturation magnetic flux density of the middle column is higher than that of the upper yoke and the lower yoke. The at least two high magnetically-permeable side columns are disposed in interval between the upper yoke and the lower yoke, and two ends of each high magnetically-permeable side column are connected to outer edges of the upper yoke and the lower yoke, respectively. The inductor magnetic core and the inductor of the present invention improves utilization of the yoke, and also provide compact structure and simple production.

13 Claims, 8 Drawing Sheets

(56) References Cited

U.S. PATENT DOCUMENTS

| | | | | |
|---|---|---|---|---|
| 2012/0218066 | A1* | 8/2012 | Inaba | H01F 37/00 336/83 |
| 2015/0069853 | A1* | 3/2015 | Wang | H02M 1/14 307/104 |
| 2015/0213942 | A1* | 7/2015 | Kuroda | H01F 37/00 336/212 |

FOREIGN PATENT DOCUMENTS

| | | | | | |
|---|---|---|---|---|---|
| CN | 104810137 | A | | 7/2015 | |
| CN | 105140004 | A | | 12/2015 | |
| CN | 206301670 | U | * | 7/2017 | H01F 17/045 |
| CN | 206301670 | U | | 7/2017 | |
| JP | 2013-247265 | A | | 12/2013 | |

* cited by examiner

INDUCTOR MAGNETIC CORE AND INDUCTOR USING THE SAME

BACKGROUND OF THE INVENTION

1. Field of the Invention

The present invention relates to a technical field of inductor, and more particularly to an inductor magnetic core and an inductor using the same.

2. Description of the Related Art

With the development of new energy technology and electric vehicles, various inductor requirements such as boost inductors for photovoltaic inverter circuits, inverter output inductors, and boost inductors for electric vehicle main power batteries become vigorous. Due to the increasing switching frequency of power semiconductor devices, conventional silicon-steel-sheet inductors having larger losses become less applicable; instead, more metal powder core inductors made by ferro-silicon and FeSiAl materials are applied in power semiconductor devices. In recent years, there are two types of metal powder core inductors, one type of metal powder core inductor adopts a ring inductor structure which has difficulty in winding and is disadvantageous for mass production; the other type of metal powder core inductor stacks block metal powder cores to form a square shape, and a coil winding is wound on a middle column clamped by upper and lower yokes, and this solution has problems of insufficient space utilization and larger size of the upper and lower yokes.

In order to solve above-mentioned problems, Chinese issued Patent No. 102918610B discloses a technical solution utilizes magnetic metal resin for encapsulation of inductor, so as to make the structure of the inductor compact; however, because magnetic permeability of the magnetic resin is generally low, the improvement of the yoke utilization is limited. Chinese issued patent No. 102074333B discloses a technical solution utilizing a mixed material to make the inductor have very compact structure and high efficiency, but this technical solution has manufacturing problems, especially for larger sizes of the inductor. Chinese issued patent No. 103714946B discloses a hybrid integrated inductor magnetic circuit, which can maintain a high coupling effect and maximize inductance of coil self-coupling, but this technical solution has problem that it is difficult to thin the ferrite core plate and there is a risk of early saturation.

SUMMARY OF THE INVENTION

The technical problem to be solved in the present invention is to provide an inductor magnetic core and an inductor using the same, so as to improve the utilization of yoke, and also achieve compact structure and simple production.

In order to solve the aforementioned problems, the present invention provides an inductor magnetic core including an upper yoke, a lower yoke, a middle column, and at least two high magnetically-permeable side columns. The middle column is disposed between a middle part of the upper yoke and a middle part of the lower yoke. A coil is wound on the middle column, and a saturation magnetic flux density of the middle column is higher than a saturation magnetic flux density of each of the upper yoke and the lower yoke. The at least two high magnetically-permeable side columns are disposed in interval between the upper yoke and the lower yoke, and two ends of each high magnetically-permeable side column are connected to the outer edges of the upper yoke and the lower yoke, respectively.

According to an embodiment of the present invention, two ends of the middle column are inserted into the upper yoke and the lower yoke, respectively, and an insertion depth ratio d/D of each of the two ends of the middle column is higher than or equal to (B1−B2)/B1, wherein d is an insertion depth of each of the two ends of the middle column, D is a thickness of each of the upper yoke and the lower yoke, B1 is the saturation magnetic flux density of the middle column, and B2 is the saturation magnetic flux density of each of the upper yoke and the lower yoke.

According to an embodiment of the present invention, two ends of the middle column penetrates through the upper yoke and the lower yoke, respectively.

According to an embodiment of the present invention, the magnetic permeability of each of the at least two high magnetically-permeable side columns is not lower than 200.

According to an embodiment of the present invention, material of each of the two high magnetically-permeable side columns is ferrite or amorphous material.

According to an embodiment of the present invention, the two high magnetically-permeable side columns are distributed around the middle column in symmetry.

According to an embodiment of the present invention, material of the middle column is metal powder core, and material of each of the upper yoke and the lower yoke is ferrite.

According to an embodiment of the present invention, metal powder core is FeSiAl or ferro-silicon material.

According to an embodiment of the present invention, the number of the middle column is one, two or more, and the multiple middle columns are arranged in interval between the middle part of the upper yoke and the middle part of the lower yoke.

According to an embodiment of the present invention, the middle column comprises an air gap disposed thereon.

The present invention further provides an inductor including a coil, and an inductor magnetic core according to one of above-mentioned embodiments. The coil is wound on the middle column.

According to an embodiment of the present invention, the inductor further includes insulated end rings disposed on upper and lower ends of the coil, respectively, and configured to isolate the coil from the middle column, and from the upper yoke and the lower yoke.

According to an embodiment of the present invention, the inductor further includes an outer shell disposed on an outer side of the inductor magnetic core.

According to an embodiment of the present invention, the inductor further includes glue filled in the outer shell and configured to bond the interior of the inductor integrally.

According to aforementioned technical solution, the present invention has following beneficial effects compared with prior art:

The saturation magnetic flux density of the middle column is higher than the saturation magnetic flux density of each of the upper yoke and the lower yoke, so that the spaces of the yokes of the magnetic core or the inductor can be utilized effectively. Utilization of the at least two high magnetically-permeable side columns to form two or more magnetic flux loops for dispersing magnetic flux can decrease the thickness of the yoke part, and make the structure of the inductor compact, and make production of the inductor easy.

Furthermore, the middle column is inserted into the upper yoke and the lower yoke, early saturation of the ferrite material of the yoke part can be prevented.

BRIEF DESCRIPTION OF THE DRAWINGS

The structure, operating principle and effects of the present invention will be described in detail by way of various embodiments which are illustrated in the accompanying drawings.

DETAILED DESCRIPTION OF THE PREFERRED EMBODIMENTS

Figure 1:
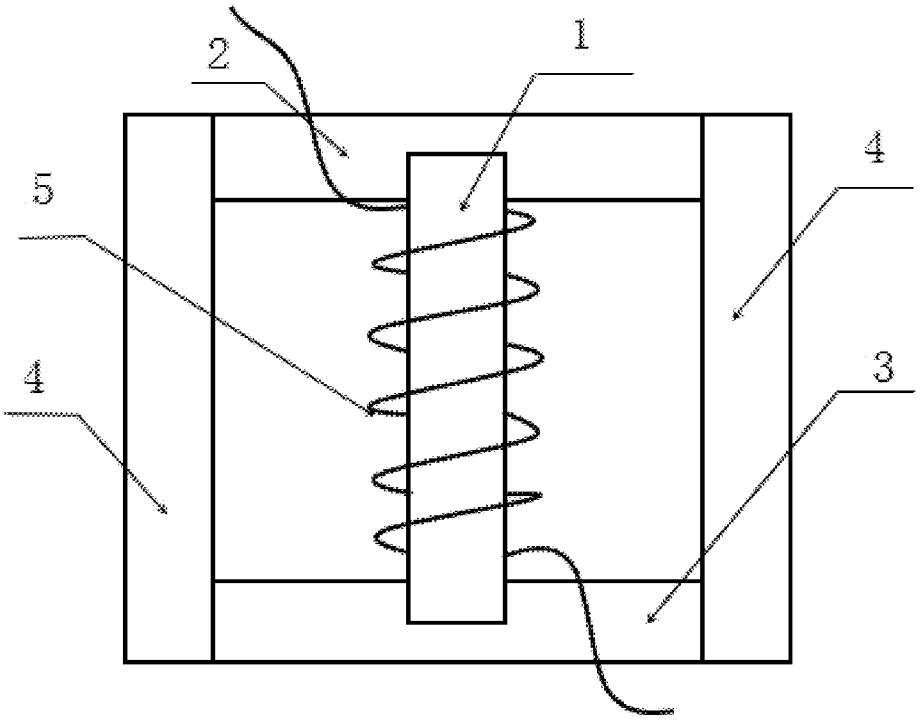
FIG. 1 is a schematic structural view of an inductor with a middle column and two high magnetically-permeable side columns, according to an embodiment of the present invention.

The following embodiments of the present invention are herein described in detail with reference to the accompanying drawings. These drawings show specific examples of the embodiments of the present invention. These embodiments are provided so that this disclosure will be thorough and complete, and will fully convey the scope of the invention to those skilled in the art. It is to be acknowledged that these embodiments are exemplary implementations and are not to be construed as limiting the scope of the present invention in any way. Further modifications to the disclosed embodiments, as well as other embodiments, are also included within the scope of the appended claims. These embodiments are provided so that this disclosure is thorough and complete, and fully conveys the inventive concept to those skilled in the art. Regarding the drawings, the relative proportions and ratios of elements in the drawings may be exaggerated or diminished in size for the sake of clarity and convenience. Such arbitrary proportions are only illustrative and not limiting in any way. The same reference numbers are used in the drawings and description to refer to the same or like parts.

It is to be acknowledged that, although the terms 'first', 'second', 'third', and so on, may be used herein to describe various elements, these elements should not be limited by these terms. These terms are used only for the purpose of distinguishing one component from another component. Thus, a first element discussed herein could be termed a second element without altering the description of the present disclosure. As used herein, the term "or" includes any and all combinations of one or more of the associated listed items.

It will be acknowledged that when an element or layer is referred to as being "on," "connected to" or "coupled to" another element or layer, it can be directly on, connected or coupled to the other element or layer, or intervening elements or layers may be present. In contrast, when an element is referred to as being "directly on," "directly connected to" or "directly coupled to" another element or layer, there are no intervening elements or layers present.

In addition, unless explicitly described to the contrary, the word "comprise", "include" and "have", and variations such as "comprises", "comprising", "includes", "including", "has" and "having" will be acknowledged to imply the inclusion of stated elements but not the exclusion of any other elements.

Please refer to FIG. 1. In an embodiment, an inductor magnetic core includes a middle column 1, an upper yoke 2, a lower yoke 3, and at least two high magnetically-permeable side columns 4. For example, a coil 5 can be wound on the middle column 1 to form an inductor. The upper yoke 2 and the lower yoke 3 are equivalent to each other, and have the same sizes and can be exchanged to each other. The shapes of the upper yoke 2 and the lower yoke 3 are not limited in the present invention. It can be understood that each of the at least two high magnetically-permeable side columns 4 is made by high magnetically-permeable material; according to different design requirement, the number of the at least two high magnetically-permeable side columns 4 can be two, three or four; the shape of the high magnetically-permeable side column 4 is not limited, for example, can be a triangular column, a polygonal column or a circular column.

The middle column 1 is disposed between a middle part of the upper yoke 2 and a middle part of the lower yoke 3. When the inductor magnetic core includes one middle column 1, the middle column 1 is disposed between a middle position of the upper yoke 2 and a middle position of the lower yoke 3; when the inductor magnetic core includes two or more middle columns 1, the all middle columns 1 are disposed correspondingly in position to the middle part of the upper yoke 2 and the middle part of the lower yoke 3, respectively. The coil 5 can be wound on the middle column 1, and saturation magnetic flux density of the middle column 1 is higher than saturation magnetic flux density of each of the upper yoke 2 and the lower yoke 3.

All of the at least two high magnetically-permeable side columns 4 are arranged in interval between the upper yoke 2 and the lower yoke 3, and two ends of each high magnetically-permeable side column are connected to an outer edge of the upper yoke 2 and an outer edge of the lower yoke 3, respectively. Each high magnetically-permeable side column 4 has an end connected to the outer edge of the upper yoke 2, and other end connected to the outer edge of the lower yoke 3. In order to form a magnetic flux loop, the two ends of each high magnetically-permeable side column and the outer edges of the upper yoke 2 and the lower yoke 3 are connected in an alignment manner, preferably; for example, the end surface of the high magnetically-permeable side column 4 is aligned with the upper surface of the upper yoke 2, or the elevation surface of the high magnetically-permeable side column 4 is aligned with the side surface of the upper yoke 3; similarly, the high magnetically-permeable side column 4 and the lower yoke 3 are connected in similar manner. The at least two high magnetically-permeable side columns 4 are independently disposed between the upper yoke 2 and the lower yoke 3.

By using particular materials to make saturation magnetic flux density of utilization of the middle column 1 higher than saturation magnetic flux density of each of the upper yoke 2 and the lower yoke 3, the space of the yoke of the magnetic core or the inductor can be utilized effectively. By utilizing at least two high magnetically-permeable side columns 4 to form two or more magnetic flux loop to disperse magnetic flux, the thickness of the yoke part can be reduced, so as to make the structure of the inductor compact, and make production of the inductor easy.

Preferably, the at least two high magnetically-permeable side columns 4 are distributed around the middle column 1 in symmetry; in other words, the all high magnetically-permeable side columns 4 are distributed in symmetry relative to the middle column 1 when there is one middle column 1, or relative to the region surrounded by the all middle columns 1, so as to effectively disperse magnetic flux of the yokes, thereby further reducing thicknesses of the yokes.

Preferably, in order to effectively utilize the space of the yoke, the material of each of the upper yoke 2 and the lower yoke 3 of an embodiment of the present invention can be ferrite generally having higher magnetic permeability, and it is useful to spread the magnetic flux in the yoke part, so as to improve the utilization of the yoke. Furthermore, the material of the middle column 1 can be metal powder core; it is well known that the saturation magnetic flux density of the metal powder core is higher than that of ferrite, so that a winding radius of the coil 5 wound on the metal powder core middle column 1 can be reduced, thereby reducing DC resistance and cost.

The metal powder core can be FeSiAl or ferro-silicon material, but the present invention is not limited thereto, and the metal powder core can be another metal powder core material.

In the conventional two-column inductor using a square-shaped magnetic core structure, magnetic flux flowing through ferrite yokes from a metal powder core middle column to another middle column of metal powder core, and the thicknesses of the upper and lower ferrite yokes are designed to be very thick in order to prevent ferrite from early saturation, and it causes a very large size and high cost of the inductor. Furthermore, when magnetic flux flowing through the ferrite yokes from one metal powder core middle column directly to another metal powder core middle column, it is disadvantageous to sufficiently utilize the spaces of the yokes, and it causes waste in space.

The embodiment of the present invention utilizes at least two high magnetically-permeable side columns 4 respectively connected to the outer edges of the upper and lower ferrite yokes, to form a magnetic flux loop, so as to solve the problem that the yoke is too thick because magnetic flux of the metal powder core middle column spreads on a ferrite yoke in a certain fixed direction.

In equivalent situation, core loss of ferrite material is far less than that of metal powder core material, so that the magnetic core using mixed materials can have core loss far less than the core loss of the annular metal powder core solution or square-shaped metal powder core block stacked solution applied in industries currently.

The materials of the upper yoke 2, the lower yoke 3 and the middle column 1 of the embodiment of the present invention are not limited to ferrite or metal powder core, and other material satisfying the condition that the saturation magnetic flux density of the middle column 1 is higher than saturation magnetic flux density of each of the upper yoke 2 and the lower yoke 3, can be applied in the present invention, and it is beneficial to reduce the winding radius of the coil 5, and further reduce DC resistance and cost of the inductor; furthermore, disposing the high magnetically-permeable side columns 4 to disperse magnetic flux loop can solve the problem that the yoke is too thick because magnetic flux of the middle column 1 spreading in a yoke in a certain fixed direction.

Preferably, the magnetic permeability of the high magnetically-permeable side column 4 is not lower than 200, so as to more effectively guide the yoke magnetic flux and block leakage of magnetic flux, and the coupling effect of the multiple middle column 1 solution can be reduced, to facilitate multiple winding to work independently.

Preferably, material of the high magnetically-permeable side column 4 can be ferrite or amorphous material, but the present invention is not limited thereto, and another high magnetically-permeable material can be applied in the present invention.

Figure 2:
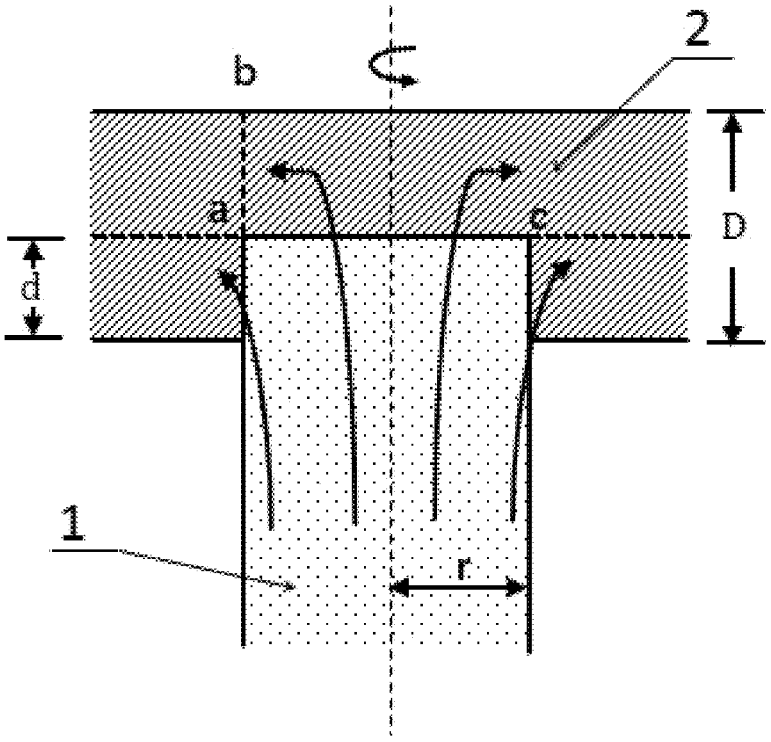
FIG. 2 is a schematic view of depths of the middle column inserted into the upper yoke and the lower yoke, according to an embodiment of the present invention.

Please refer to FIGS. 1 and 2. In an embodiment, two ends of the middle column 1 are inserted into the upper yoke 2 and the lower yoke 3, respectively, to prevent the contact surface "ac" between the middle column 1 and the upper yoke 2 from being saturated early. The magnetic flux passing through the annular surface "ab" should be lower than or equal to B2/B1 times of the total magnetic flux, that is, $(D-d)/D \leq B2/B1$. Therefore, the insertion depth ratio d/D of each of the two ends of the middle column 1 is higher than or equal to $(B1-B2)/B1$, wherein d is an insertion depth of an end of the middle column 1, D is the thickness of each of the upper yoke 2 and the lower yoke 3, B1 is the saturation magnetic flux density of the middle column 1, B2 is the saturation magnetic flux density of each of the upper yoke 2 and the lower yoke 3.

Figure 3:
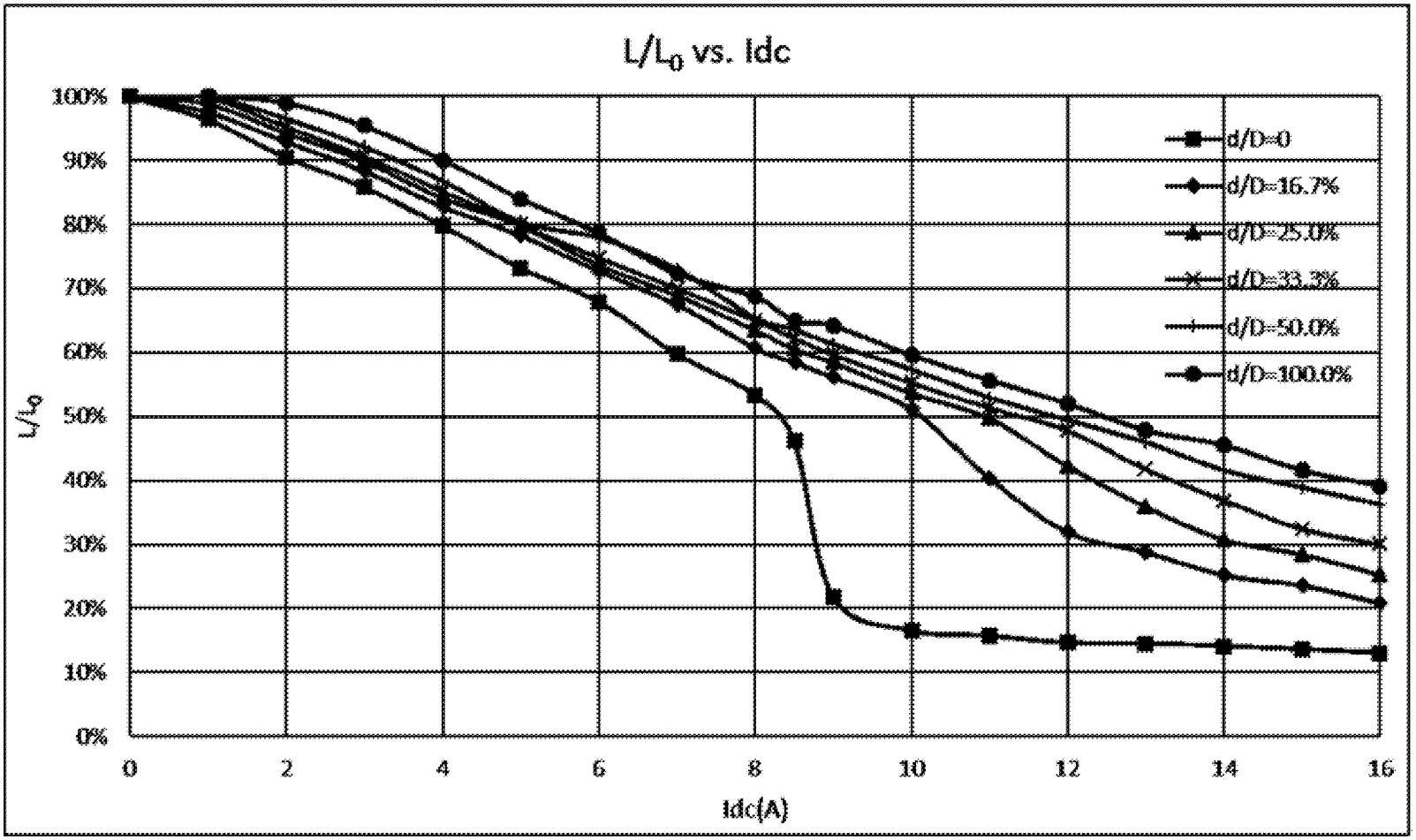
FIG. 3 is a schematic view of saturation characteristic versus the depth of the middle column inserted into each of the upper yoke and the lower yoke, according to an embodiment of the present invention.

The upper yoke 2 and the lower yoke 3 being ferrite material and the middle column 1 being metal powder core material are taken as examples for illustration in following paragraphs, to illustrate the purpose of inserting the middle column 1 into the yoke and setting the ratio of the insertion depth, with reference to FIGS. 2 and 3. The illustration can be similarly applied to the condition of other material.

As described above, the saturation magnetic flux density of ferrite material is lower than that of metal powder core, as shown in FIG. 2, partial saturation of the ferrite material occurs easily on the contact surface "ac" between the middle column 1 made by metal powder core and the upper yoke 2 made by ferrite material, and it is similar for the lower yoke 3. In general, saturation magnetic flux density of the metal powder core is about higher than five-fourth of saturation magnetic flux density of ferrite, in order to prevent early saturation from occurring on the contact surfaces "ac", and the magnetic flux passing through the annular surfaces "ab" should be lower than or equal to ⅘ of the total magnetic flux, that is, $(D-d)/D \leq 4/5$ and ⅕. The depth of the middle column of the metal powder core inserted into the ferrite yoke is more than one fifth of the thickness of the ferrite yoke.

As shown in FIG. 2, the two ends of the metal powder core middle column are inserted into the upper and lower ferrite yokes, and the insertion positions are located in the middle parts of the ferrite yokes, so that the magnetic flux in the middle column of metal powder core can disperse into the ferrite yoke and not flow in a certain direction, and it is beneficial for reduction of the total thickness of the ferrite yoke.

As shown in FIG. 3, when the metal powder core middle column is not fully inserted into the ferrite yoke or the depth of inserting into the ferrite yoke is smaller than one-fifth of the thickness of the yoke (d/D=0, 16.7%), the saturation current curve of the inductor suddenly falls in the rear section and the saturation L/LO of the current ldc suddenly falls after 8 Amps, and it may occur excessive ripple in heavy load or may impact output stability of the circuit when the ripple is more serious. When the insertion depth is at least one-fifth of the thickness of the ferrite yoke (d/D=25.0%, 33.3%, 50.0%, and 100%), it can observe that the saturation current curve is very smooth, and the anti-saturation capability is improved greatly.

Preferably, the upper yoke 2 and the lower yoke 3 can have through holes cut therethrough and formed on two end portions of the middle column 1, so that it can make sure the upper yoke 2 and the lower yoke 3 not to occur saturation early, and it is also easier to implement. In other words, two ends of the middle column 1 can penetrate the upper yoke 2 and the lower yoke 3, respectively.

in an embodiment, the number of the middle column 1 can be one, two or more, the multiple middle columns 1 are disposed in interval between the middle part of the upper yoke 2 and the middle part of the lower yoke 3. The region surrounded by the multiple middle columns 1 corresponds in position to the middle parts of the upper yoke 2 and the lower yoke 3.

Preferably, the middle column 1 has an air gap 11 formed thereon and configured to improve anti-saturation capability of the inductor.

Please refer to FIG. 1. In an embodiment, the inductor magnetic core of the aforementioned embodiment can be applied in an inductor, and the inductor includes a coil 5 and the inductor magnetic core of any one of the aforementioned embodiments, and the coil 5 is wound on the middle column 1.

Particularly, as shown in FIG. 1, the coil 5 is wound on the middle column 1, and clamped by the upper yoke 2 and the lower yoke 3. The depth d of two ends of the middle column 1 inserted into the upper yoke 2 and the lower yoke 3 can be, for example, a half of the thickness D of the yoke, so as to prevent the upper yoke 2 and the lower yoke 3 from being saturated early. Furthermore, the middle column 1 is inserted into middle parts of the upper yoke 2 and the lower yoke 3, and the two high magnetically-permeable side columns 4 are connected to the outer edges of the upper yoke 2 and the lower yoke 3, to form a magnetic flux loop, so as to disperse the yoke magnetic flux flow and make the yoke compact.

Figure 4:
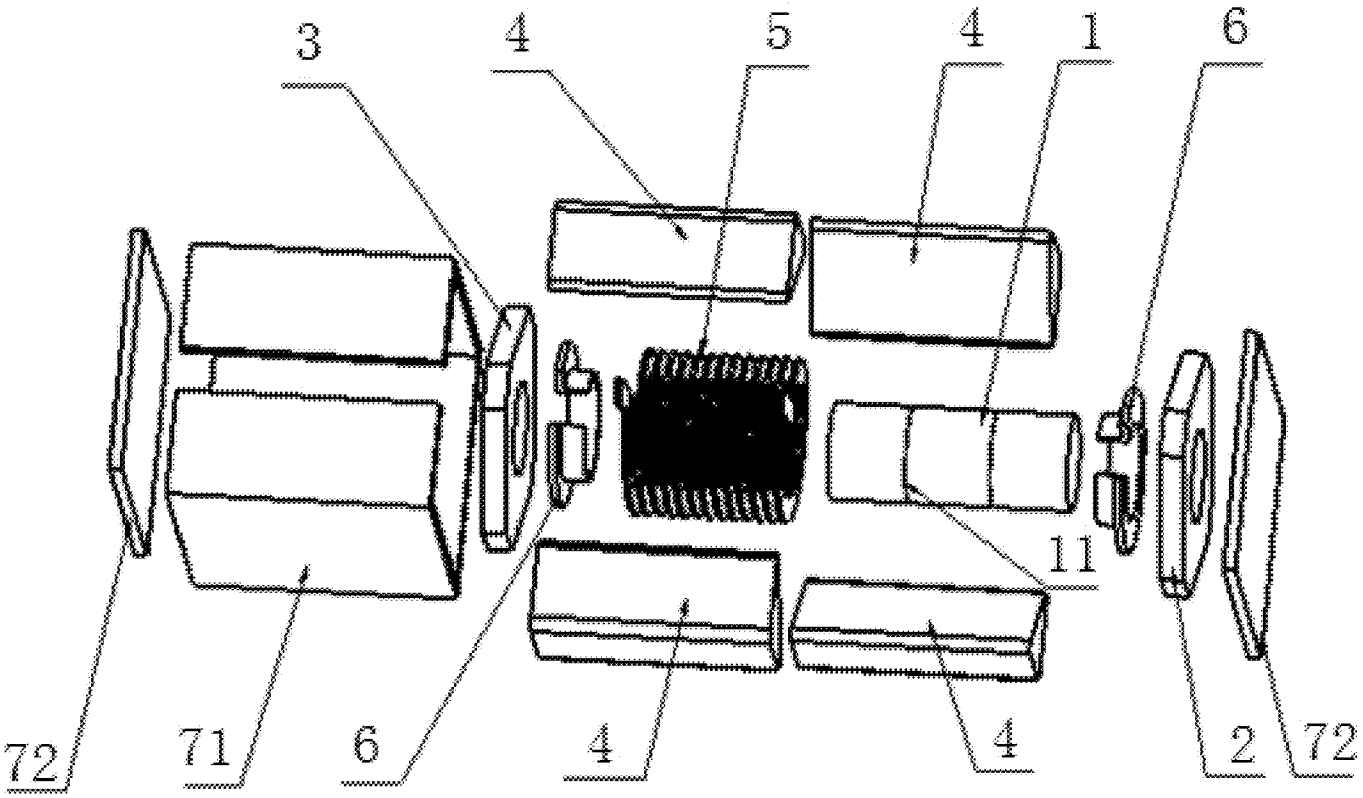
FIG. 4 is an exploded structural view of an inductor with a middle column and four high magnetically-permeable side columns, according to an embodiment of the present invention.

Please refer to FIG. 4, which is an exploded structural view of an inductor product. In another embodiment, the coil 5 is wound on the middle column 1 and clamped by the upper yoke 2 and the lower yoke 3, and four independent high magnetically-permeable side columns 4 are disposed around the middle column 1 in symmetry, so as to disperse flow of magnetic flux of the upper yoke 2 and the lower yoke 3. The middle column 1 is fully inserted into the upper yoke 2 and the lower yoke 3, and inserted into middle parts of the upper yoke 2 and the middle part of the lower yoke 3. The four independent high magnetically-permeable side columns 4 are connected to the outer edges of the upper yoke 2 and the lower yoke 3, to form a magnetic flux loop, thereby dispersing the yoke magnetic flux flow to make the yoke compact. The other components of this embodiment are similar to that of the aforementioned embodiment, so their descriptions can be referred to that of the aforementioned embodiment.

Preferably, material of the middle column 1 can be FeSiAl metal powder core, to improve the anti-saturation capability of the inductor. Furthermore, two air gaps 11 can be formed on the middle column 1, and the amount of the air gaps 11 is not limited in the present invention. The material of each of the upper yoke 2, the lower yoke 3 and the four independent high magnetically-permeable side columns 4 can be MnZn ferrite having magnetic permeability of 2300.

Preferably, insulated end rings 6 can be disposed on upper and lower ends of the coil 5, to isolate the coil 5 from the middle column 1, and from the upper yoke 2 and the lower yoke 3. As shown in FIG. 4, upper and lower insulated end rings 6 are used to insulate the coil 5 from the middle column 1, and from the upper yoke 2 and the lower yoke 3.

Preferably, the inductor can have an outer shell disposed on the outer side of the inductor magnetic core. As shown in FIG. 4, the outer shell comprises an outer shell cover plate 72 and an outer shell main body 71 which are connected to form an enclosed space to fix the upper yoke 2, the lower yoke 3 and the four independent high magnetically-permeable side columns 4. Similarly, the inductor of other embodiment also can have an outer shell.

Furthermore, in an embodiment, glue can be filled in the outer shell, to bond the interior of the inductor integrally. The outer shell can have a slot cut through a side wall thereof, and the glue can be filled into the outer shell via the slot, so as to form the inductor integrally to enhance thermal conduction capability and inhibit working noise.

Figure 5:
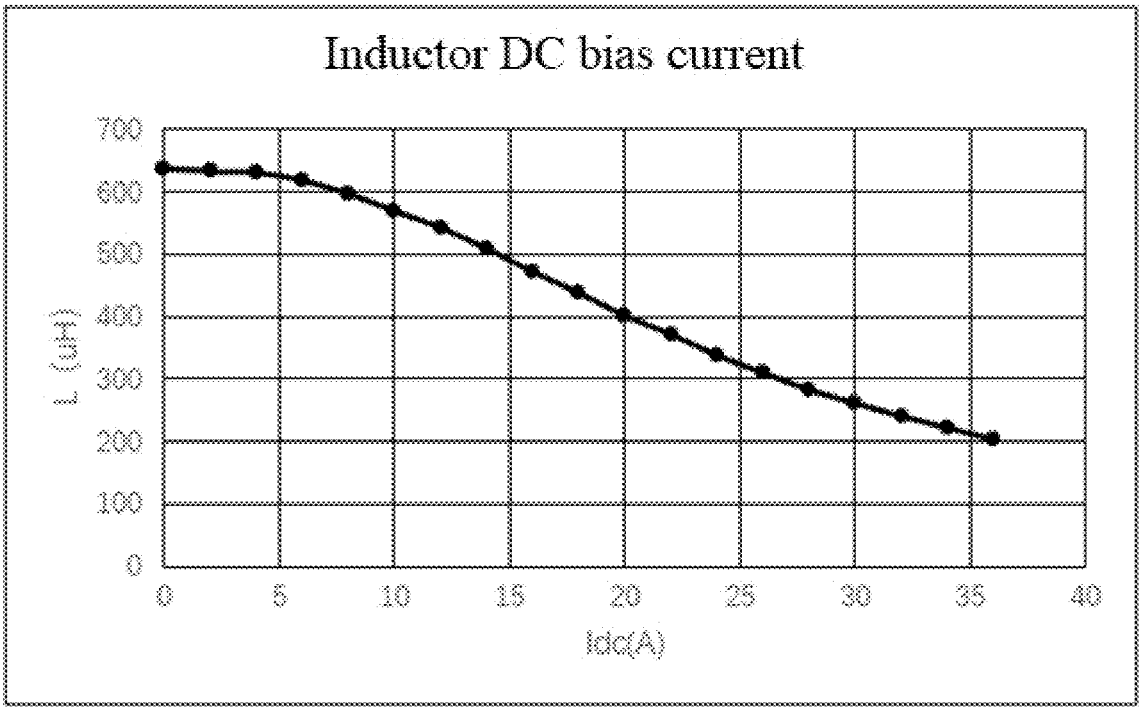
FIG. 5 is a saturation curve diagram of a single-phase inductor, according to an embodiment of the present invention.
Figure 6:
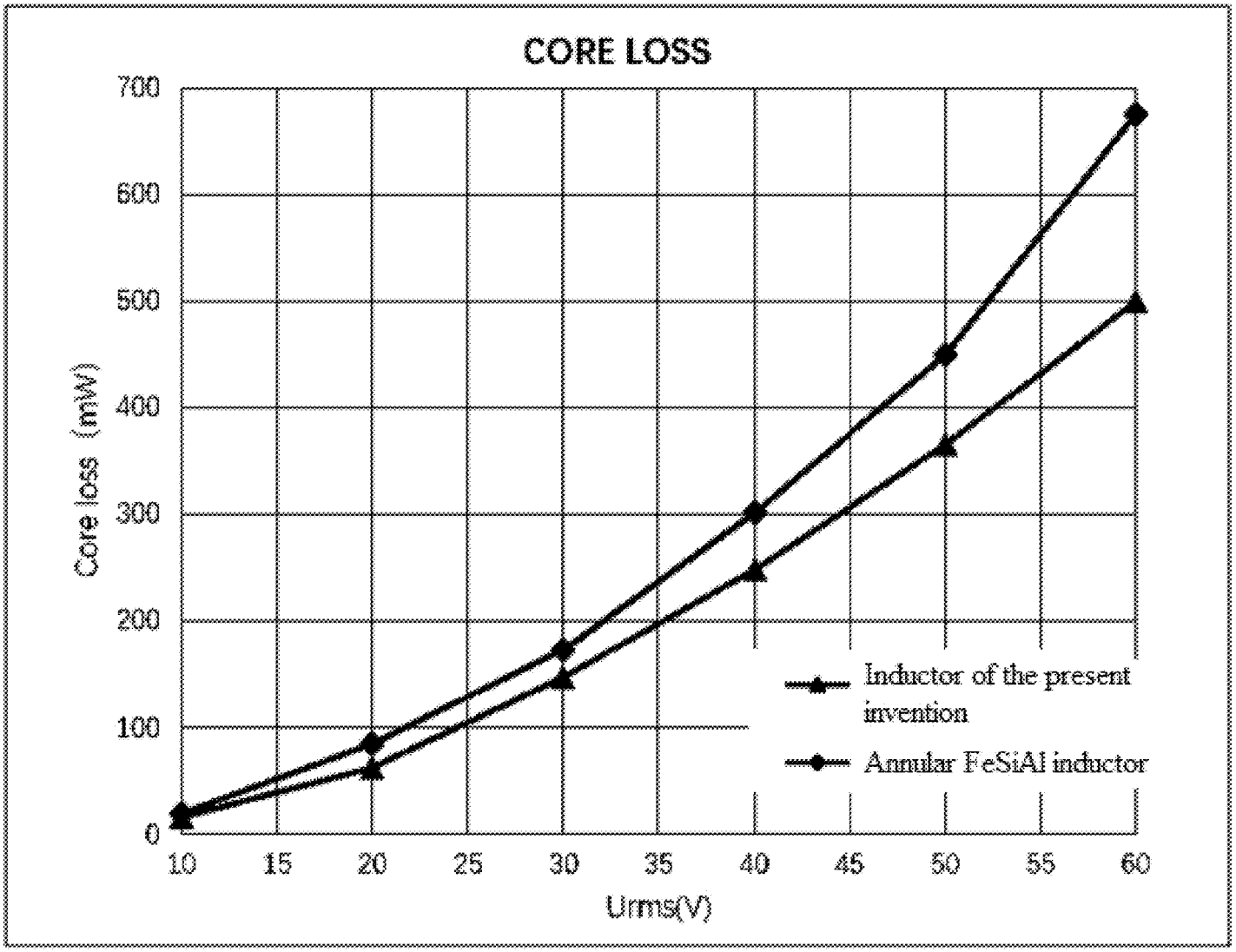
FIG. 6 is a comparison diagram of core loss of an annular FeSiAl inductor, and core loss of a single-phase inductor of an embodiment of the present invention.

FIG. 5 shows a saturation curve of an inductor of this embodiment. The curve of inductance versus inductor DC bias current can indicate that the saturation curve of this embodiment is very smooth, it means that the yoke is not saturated early. Please refer to FIG. 6, which shows comparison between core loss of the inductor of this embodiment and the core loss of the annular FeSiAl inductor with the same specification and similar size. The inductor of this embodiment has significant advantage in core loss.

In an actual application, multiple coils may be used, for example, two-column single-phase inductor can increase anti-saturation capability of the inductor; for example, two-phase or three-phase inductors must be integrated together to reduce cost. According to the contents of the embodiments of the present invention, the embodiments of the present invention can be expanded to a solution integrated with multiple coils, so as to decrease size and satisfy the requirements for single-phase multiphase inductor in different occasions.

Figure 7:
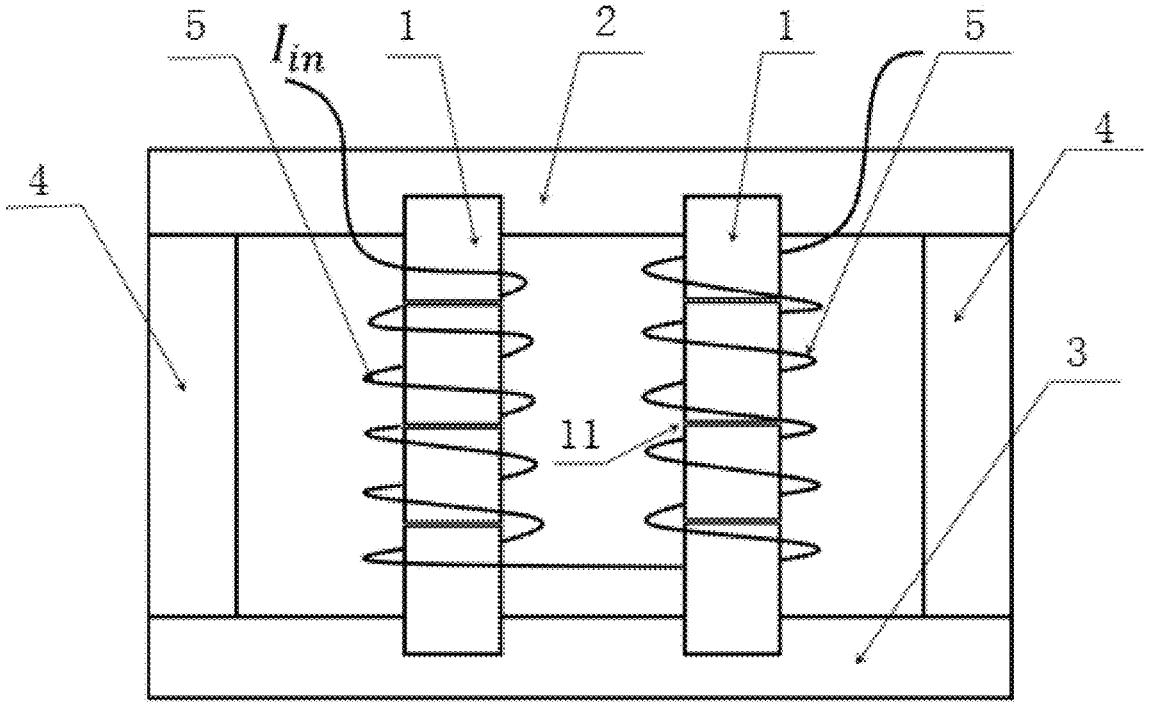
FIG. 7 is a schematic structural view of an inductor with a two middle columns and two high magnetically-permeable side columns, according to an embodiment of the present invention.

Please refer to FIG. 7, which is a two-column single-phase inductors. In another embodiment, two coils 5 on two middle columns 1 are connected in series to form a winding, and an input terminal of the winding receives current tin, the middle column 1 is inserted into the upper yoke 2 and the lower yoke 3 by a half of thickness of the upper yoke 2 and the lower yoke 3, and at the middle part of the upper yoke 2 and the middle part of the lower yoke 3. The middle column 1 has six air gaps 11 formed thereon, and two independent high magnetically-permeable side columns 4 are connected to the outer edges of the upper yoke 2 and the lower yoke 3. The material of each of the two independent high magnetically-permeable side columns 4 is amorphous.

Compared with the single-column inductor, the two-column single-phase inductor can store double energy to well match the requirement in high current.

Figure 8:
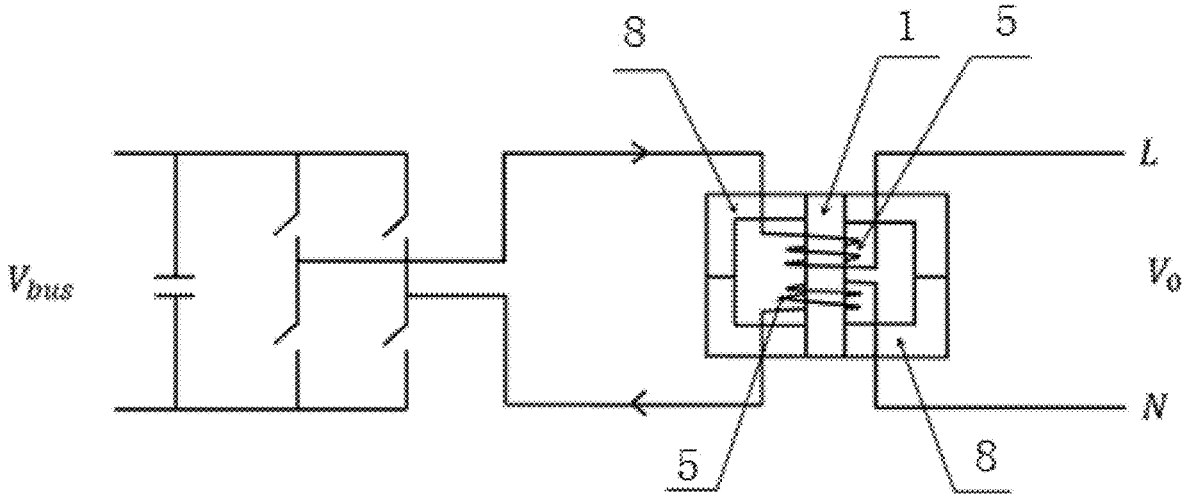
FIG. 8 is a schematic structural view of an application circuit of an inductor an embodiment of the present invention, applied in an inverter circuit.

Please refer to FIG. 8, which shows an inductor with one middle column 1 and two coils 5. This inductor can be applied in an inverter circuit. The upper yoke and the lower yoke and the two high magnetically-permeable side columns can be formed integrally. The material of the high magnetically-permeable side column can be ferrite. In an embodiment, the upper yokes, the lower yokes and the two high magnetically-permeable side columns of two U-shaped integrally-formed structures 8 can be connected to each other, so as to form the magnetic circuit loop. The material of the middle column 1 can be metal powder core material, and the metal powder core material can be ferro-silicon, and the middle column 1 is fully inserted into the upper yokes and the lower yokes of the integrally-formed structure 8, and is inserted into the middle parts of the upper yoke and the lower yoke. The two coils 5 are disposed on the middle column 1 to form two windings, which serve as inductor for output end of the inverter, Vbus is an input voltage, and Vo is an output voltage. This structure is beneficial for reduction of size of the inductor, and since the structure of the inductor is in symmetry along a L line and a N line, it is advantageous to inhibit common-mode noise.

Figure 9:
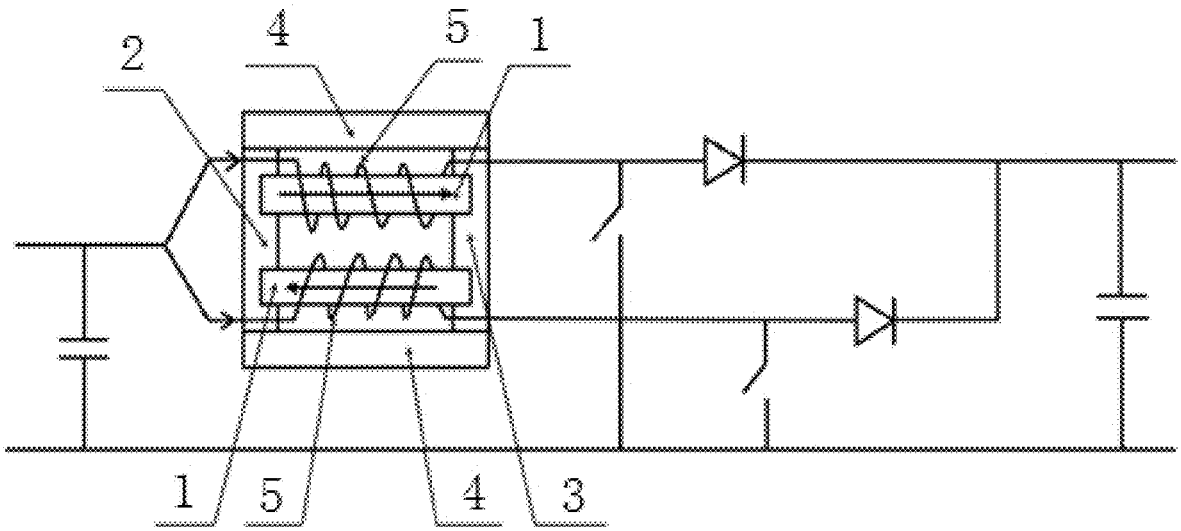
FIG. 9 is a schematic structural view of an application circuit of an inductor of an embodiment of the present invention, applied in a PFC circuit.

Please refer to FIG. 9, which shows a schematic circuit diagram of an inductor of an embodiment of the present invention applied in solar inverter interleaved PFC circuit. As shown in FIG. 9, in another embodiment, two coils 5 are mounted on the two middle column 1, respectively; the material of the middle column 1 is FeSiAl, the middle column 1 is inserted into the upper yoke 2 and the lower yoke 3 by a depth exceeding one-fourth of thickness of the upper yoke 2 and the lower yoke 3, and is inserted at the middle parts of the upper yoke 2 and the middle part of the lower yoke 3. The left and right high magnetically-permeable side columns 4 are connected to the upper yoke 2 and the lower yoke 3. The two coils 5 form the two windings wound on the two middle columns 1, to form two-phase PFC inductors working independently. The material of the high magnetically-permeable side column 4 is amorphous lamination, which has magnetic permeability higher than 5000. Since magnetic permeability of each of the upper yoke 2, the lower yoke 3 and the two high magnetically-permeable side columns 4 is higher, the coupling coefficient between the two-phase PFC inductors is small, so that the two-phase PFC inductors can be operated independently.

Figure 10:
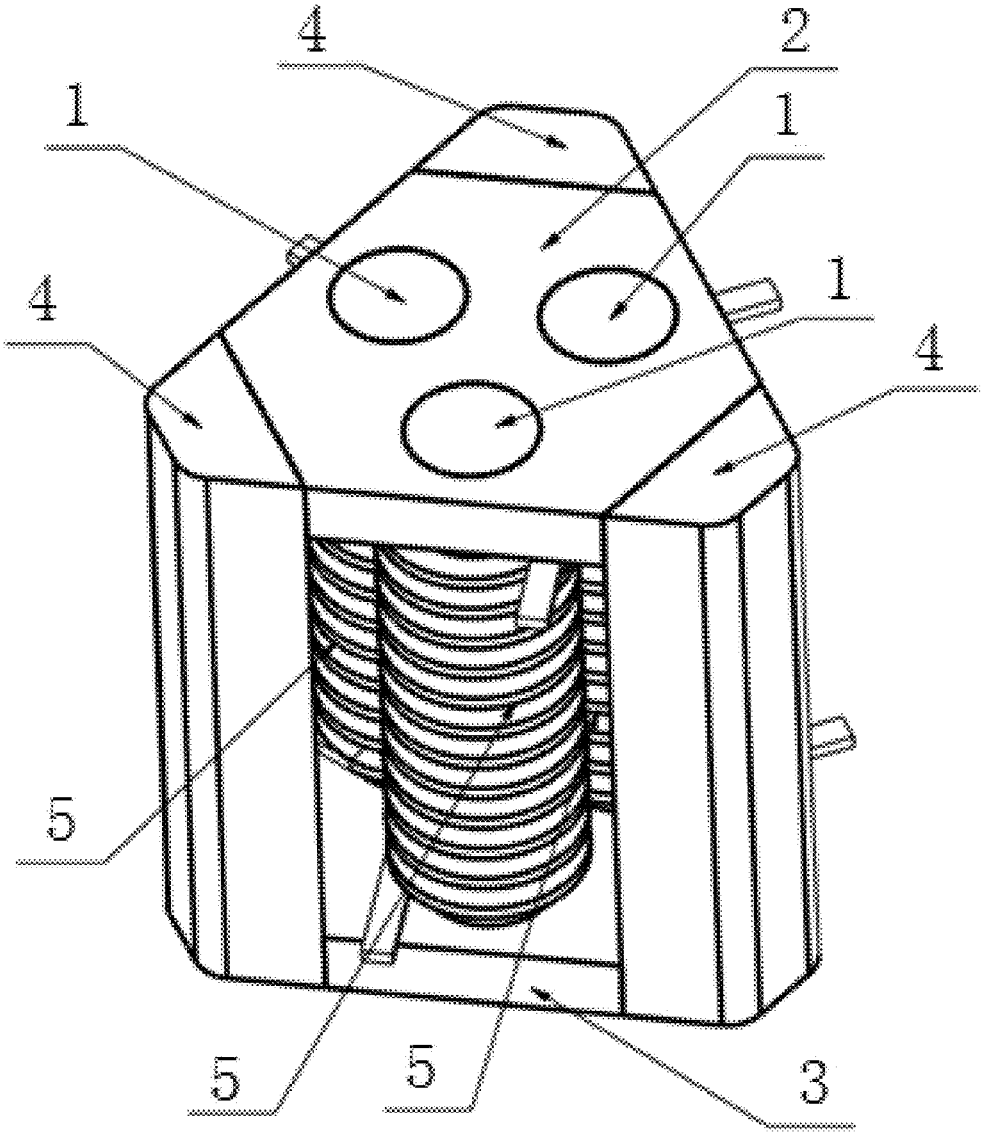
FIG. 10 is a schematic structural view of an inductor with three middle columns and three high magnetically-permeable side columns, according to an embodiment of the present invention.

Please refer to FIG. 10, which is a three-phase inductor of an embodiment of the present invention applied in a high-power inverter LC output filter network, or a LCL output filter network. In this embodiment, the three-phase inductor includes three middle columns 1, and each middle column 1 is provided with winding of a vertical coil 5 corresponding thereto. All of the middle column 1 and the coil 5 are clamped by the upper yoke 2 and the lower yoke 3, and the three middle columns 1 are fully inserted into the upper yoke 2 and the lower yoke 3, and are inserted on the middle part of the upper yoke 2 and the middle part of the lower yoke 3. Three independent high magnetically-permeable side columns 4 are connected to the outer edges of the upper yoke 2 and the lower yoke 3, to form a magnetic flux loop. The material of the middle column 1 can be FeSiAl metal powder core, materials of the upper yoke 2, the lower yoke 3 and the three independent high magnetically-permeable side columns 4 are MnZn ferrite. The three-phase inductor of this embodiment can have compact structure, so as to implement higher power output and less core loss. Furthermore, the three-phase inductors can be integrated together, cost can be effectively reduced.

The present invention disclosed herein has been described by means of specific embodiments. However, numerous modifications, variations and enhancements can be made thereto by those skilled in the art without departing from the spirit and scope of the disclosure set forth in the claims.

What is claimed is:

1. An inductor magnetic core, comprising:

an upper yoke;

a lower yoke, wherein the lower yoke is lower than the upper yoke;

a middle column disposed between a middle part of the upper yoke and a middle part of the lower yoke, wherein a coil is wound on the middle column, and a saturation magnetic flux density of the middle column is higher than a saturation magnetic flux density of each of the upper yoke and the lower yoke; and at least two magnetically-permeable side columns disposed in interval between the upper yoke and the lower yoke, and two ends of each magnetically-permeable side column are connected to outer edges of the upper yoke and the lower yoke, respectively wherein two ends of the middle column are inserted into the upper yoke and the lower yoke, respectively, and an insertion depth ratio d/D of each of the two ends of the middle column is higher than or equal to (B1−B2)/B1, wherein d is an insertion depth of each of the two ends of the middle column inserted into the upper yoke and the lower yoke, D is a thickness of each of the upper yoke and the lower yoke, B1 is the saturation magnetic flux density of the middle column, and B2 is the saturation magnetic flux density of each of the upper yoke and the lower yoke.

2. The inductor magnetic core according to claim 1, wherein the two ends of the middle column penetrates through the upper yoke and the lower yoke, respectively.

3. The inductor magnetic core according to claim 1, wherein magnetic permeability of each of the at least two magnetically-permeable side columns is not lower than 200.

4. The inductor magnetic core according to claim 1, wherein material of each of the at least two magnetically-permeable side columns is ferrite or amorphous material.

5. The inductor magnetic core according to claim 1, wherein the at least two magnetically-permeable side columns are distributed around the middle column in symmetry.

6. The inductor magnetic core according to claim 1, wherein material of the middle column is metal powder core, and material of each of the upper yoke and the lower yoke is ferrite.

7. The inductor magnetic core according to claim 6, wherein the metal powder core is FeSiAl or ferro-silicon material.

8. The inductor magnetic core according to claim 1, wherein a number of the middle column is one, two or more, and multiple middle columns are arranged in interval between the middle part of the upper yoke and the middle part of the lower yoke.

9. The inductor magnetic core according to claim 1, wherein the middle column comprises an air gap disposed thereon.

10. An inductor, comprising:

the coil; and the inductor magnetic core according to claim 1, wherein the coil is wound on the middle column.

11. The inductor according to claim 10, further comprising insulated end rings disposed on upper and lower ends of the coil, respectively, and configured to isolate the coil from the middle column, and from the upper yoke and the lower yoke, wherein the lower end of the coil is lower than the upper end of the coil.

12. The inductor according to claim 10, further comprising an outer shell disposed on an outer side of the inductor magnetic core.

13. The inductor according to claim 12, further comprising glue filled in the outer shell and configured to bond interior of the inductor integrally.

* * * * *